US009061393B2

(12) United States Patent
Sugita et al.

(10) Patent No.: US 9,061,393 B2
(45) Date of Patent: Jun. 23, 2015

(54) SANDER

(71) Applicant: Makita Corporation, Anjo-shi, Aichi (JP)

(72) Inventors: Fumihide Sugita, Anjo (JP); Yuji Yamamoto, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 248 days.

(21) Appl. No.: 13/718,476

(22) Filed: Dec. 18, 2012

(65) Prior Publication Data

US 2013/0165027 A1 Jun. 27, 2013

(30) Foreign Application Priority Data

Dec. 21, 2011 (JP) ..... 2011-280180

(51) Int. Cl.

| | |
|---|---|
| ***B24B 23/00*** | (2006.01) |
| ***B24B 23/03*** | (2006.01) |
| ***B25F 5/02*** | (2006.01) |
| ***B24B 23/04*** | (2006.01) |

(52) U.S. Cl.

CPC ..... *B24B 23/03* (2013.01); *B24B 23/00* (2013.01); *B25F 5/02* (2013.01); *B24B 23/04* (2013.01)

(58) Field of Classification Search

CPC ..... B24B 23/03; B24B 23/00; B35F 5/02
USPC ..... D8/61, 62; D32/17; 451/354, 355, 356, 451/357, 358, 359
See application file for complete search history.

(56) References Cited

U.S. PATENT DOCUMENTS

| | | | | |
|---|---|---|---|---|
| 4,158,246 | A | 6/1979 | Meadows et al. | |
| D326,398 | S | 5/1992 | Fushiya et al. | |
| D490,676 | S * | 6/2004 | Wright | D8/62 |
| D538,122 | S * | 3/2007 | Etter et al. | D8/62 |
| D548,556 | S * | 8/2007 | Stratford | D8/62 |
| 7,270,591 | B2 | 9/2007 | Deshpande et al. | |
| 7,291,062 | B2 | 11/2007 | Kiss et al. | |
| D559,640 | S * | 1/2008 | Kraus et al. | D8/62 |
| D567,047 | S * | 4/2008 | Okuda et al. | D8/62 |
| D618,867 | S * | 6/2010 | Schouten | D32/19 |
| D621,676 | S * | 8/2010 | Baxter | D8/62 |
| 7,794,308 | B2 * | 9/2010 | Wuensch et al. | 451/344 |
| D636,243 | S * | 4/2011 | Liu et al. | D8/62 |
| D640,109 | S * | 6/2011 | Lung NG | D8/62 |
| D658,023 | S * | 4/2012 | Yamamoto et al. | D8/62 |

(Continued)

FOREIGN PATENT DOCUMENTS

| | | |
|---|---|---|
| GB | 2 416 317 A | 1/2006 |
| GB | 2 433 463 A | 6/2007 |

(Continued)

OTHER PUBLICATIONS

Aug. 4, 2014 extended European Search Report issued in EP Application No. 12190003.9.

(Continued)

*Primary Examiner* — Timothy V Eley
(74) *Attorney, Agent, or Firm* — Oliff PLC

(57) ABSTRACT

A sander includes an upper portion configured as a holding portion, and side peripheral portions. At least one constriction is formed in the side peripheral portions in such a manner as to be sunk into the side peripheral portions. The constriction is configured to be dent with respect to the holding portion.

11 Claims, 6 Drawing Sheets

(56) References Cited

U.S. PATENT DOCUMENTS

| | | | | | |
|---|---|---|---|---|---|
| D671,386 | S | * | 11/2012 | Ni | D8/64 |
| D679,159 | S | * | 4/2013 | Waldron | D8/62 |
| D718,998 | S | * | 12/2014 | Tirone et al. | D8/62 |
| 2001/0004580 | A1 | * | 6/2001 | Legner et al. | 451/359 |
| 2002/0037691 | A1 | * | 3/2002 | Mayr et al. | 451/356 |
| 2002/0100597 | A1 | * | 8/2002 | Numata | 173/217 |
| 2003/0228833 | A1 | * | 12/2003 | Boyer | 451/344 |
| 2004/0103490 | A1 | | 6/2004 | Long et al. | |
| 2005/0221737 | A1 | | 10/2005 | Cooper et al. | |
| 2005/0221738 | A1 | | 10/2005 | Cooper et al. | |
| 2006/0068689 | A1 | | 3/2006 | Kiss et al. | |
| 2008/0254721 | A1 | | 10/2008 | Wuensch | |
| 2009/0221221 | A1 | * | 9/2009 | McRoberts et al. | 451/357 |
| 2010/0009608 | A1 | | 1/2010 | Lo et al. | |
| 2010/0120340 | A1 | | 5/2010 | Fukinuki et al. | |
| 2010/0186980 | A1 | * | 7/2010 | Heilig et al. | 173/217 |
| 2012/0135671 | A1 | * | 5/2012 | Klabunde et al. | 451/358 |
| 2012/0157257 | A1 | * | 6/2012 | Hirabayashi et al. | 475/159 |
| 2014/0116741 | A1 | * | 5/2014 | Miyazawa et al. | 173/213 |

FOREIGN PATENT DOCUMENTS

| | | | |
|---|---|---|---|
| JP | 2001310273 | A | 11/2001 |
| JP | 2005279891 | A | 10/2005 |
| JP | 2006000948 | A | 1/2006 |
| JP | A-2009-166147 | | 7/2009 |
| JP | 2010012589 | A | 1/2010 |
| WO | WO 2013/093619 | A2 | 6/2013 |

OTHER PUBLICATIONS

Mar. 17, 2015 Office Action issued in Japanese Application No. 2011-280180.

* cited by examiner

SANDER

BACKGROUND OF THE INVENTION

This application claims the benefit of Japanese Patent Application Number 2011-280180 filed on Dec. 21, 2011, the entirety of which is incorporated by reference.

TECHNICAL FIELD

The present invention relates to a sander.

BACKGROUND ART

A sander called palm sander is known in the art, for example, from U.S. Pat. No. 7,291,062. This type of sander is operated with one hand by holding an upper part of the housing that is positioned opposite to an abrasive pad (i.e., a palm type sander having an upper portion equipped with a single hand operable holding portion). This holding portion is shaped as a lying semi-cylinder having a width substantially the same as that of the main body disposed under the holding portion so that the holding portion and the main body are connected together to form continuous surfaces.

Another type of sander is known, for example, from Japanese Laid-open Patent Application, Publication No. 2009-166147. This sander is not a palm type sander and has a long holding portion operable with both hands, however, the holding portion is shaped as a lying cylinder. This sander has recesses at a center portion located between a base portion disposed above the tool (pad) and the holding portion, such that when the user places his hand on the holding portion from above, fingertips of the user are placed on the recesses.

However, according to the sander disclosed in U.S. Pat. No. 7,291,062 B2, the holding portion in the shape of a lying semi-cylinder is easy to hold from above but is difficult to hold from side peripheral portions, such as front, rear, and both sides of the holding portion (i.e., directions toward the side peripheral portions).

In the meantime, according to the sander disclosed in JP 2009-166147A, because the user can place his fingertips on the recesses to hold the holding portion, the holding portion can provide better grip and matches the shape of the user's hands when he holds the holding portion from above. However, the holding portion is difficult to hold from front or rear because the battery and the motor storage portion interfere with the user's hand or the fingertips of the user do not reach the recesses. Further, it is also difficult for the user to hold the holding portion from one side portion because of the shape of the holding portion which is long in the front-and-rear direction.

In view of the above, it would be desirable to provide a sander, which is easy to hold from any directions other than from above and can realize a stable operation.

SUMMARY OF THE INVENTION

In accordance with the present invention as embodied and described herein as a first aspect, a sander comprises an upper portion configured as a holding portion, side peripheral portions, and at least one constriction formed in the side peripheral portions and sunk into the side peripheral portions. In this sander, the constriction is configured to be dent with respect to the holding portion.

Preferably, in a second aspect, the sander may be configured such that the constriction has projections.

Preferably, in a third aspect, the sander may be configured such that the constriction is provided with a dent portion which extends in a horizontal direction and is sunk more deeply into the side peripheral portions than the constriction.

Preferably, in a fourth aspect, the sander may be configured such that an extension portion configured to extend outward from the constriction is disposed at a lower side of the constriction.

Preferably, in a fifth aspect, the sander may be configured such that an end edge of the constriction has a stepped portion which is sunk more deeply into the side peripheral portions.

Preferably, in a sixth aspect, the sander may further comprise a battery attachment portion, to which is attached a battery for supplying power to a motor to drive a pad, and an end edge of the constriction which is located close to the battery attachment portion may be arranged closer to the battery attachment portion than the center of gravity of the entire sander.

Preferably, in a seventh aspect, the sander may further comprise an output shaft driven by a motor, and a pad attached to the output shaft, and the sander may be configured such that when the output shaft rotates, the pad is driven to rotate around its center while the center of the pad makes an eccentric rotation.

Preferably, in an eighth aspect, the sander may further comprise a battery attachment portion, to which is attached a battery for supplying power to a motor to drive a pad, and the battery may be attached to the battery attachment portion in a tilted posture such that the position of the battery is disposed inward as it goes downward.

Preferably, in a ninth aspect, the sander may further comprise a battery attachment portion, to which is attached a battery for supplying power to a motor to drive a pad, and an upper portion of the battery may be located at the same height with an upper portion of a housing of the sander in a state in which the battery is attached to the battery attachment portion.

Preferably, in a tenth aspect, the sander may be configured such that the constriction is configured to be sunk deeply into the side peripheral portions as it goes farther from a side where a user holds the sander.

With these configurations of the sander according to the first, and seventh to tenth aspects, because the constriction at the side peripheral portions is also dent with respect to the upper portion, the user can hold the sander not only from the upper portion but also from the side peripheral portions. If the user holds the sander from outside the side peripheral portions, he can firmly grip the constriction which is sunk deeply into the side peripheral portions, with the result that fingers liable to slip from the grasp toward the upper portion can be supported to realize a stable operation using the user's hand.

With the configuration of the sander according to the second aspect, in addition to the above advantageous effects, providing projections on the constriction allows the user to catch the projections with fingers while holding the sander from outside the side peripheral portions, with the result that slippage of hand (especially in a near-to-far direction) during the manipulation can be prevented.

With the configuration of the sander according to the third aspect, because the constriction is provided with a dent portion, in addition to the above advantageous effects, the user can catch the dent portion with a part of his fingers. This can further improve the antislippage effect.

With the configuration of the sander according to the fourth aspect, because an extension portion is disposed at the lower side of the constriction, in addition to the above advantageous effects, slippage of hand from the side peripheral portions in a downward direction can be prevented. This can ensure a more reliable and stable operation of the sander and prevent a hand of the user from contacting the pad.

With the configuration of the sander according to the fifth aspect, because the stepped portion which is sunk more deeply into the side peripheral portions is provided at the rear end edge of the constriction, that is, at the opposite side (far side) from the side where the user starts to hold the sander, in addition to the above advantageous effects, a more stable operation of the sander can be ensured by putting the user's fingers in the stepped portion.

Further, with the configuration of the sander according to the sixth aspect, because the rear end edge of the constriction is arranged farther than the vertical line passing through the center of gravity of the sander, in addition to the above advantageous effects, when the user holds the sander from side peripheral portions the center of gravity of the sander is in a portion held by the user. This can further improve the operability of the sander.

Other and further objects, features and advantages of the present invention will appear more fully from the following description.

BRIEF DESCRIPTION OF THE DRAWINGS

To better understand the claimed invention, and to show how the same may be carried into effect, reference will now be made, by way of example only, to the accompanying drawings.

DETAILED DESCRIPTION OF THE INVENTION

With reference to the accompanying drawings, an embodiment of the present invention will be described in detail.

A sander 1 is a palm sander which is operable with one hand of a user by holding an upper portion 2*a* (holding portion) of a housing 2. Buttons 3*a*, 3*b* are provided at a side wall of the upper portion 2*a*.

Figure 5:
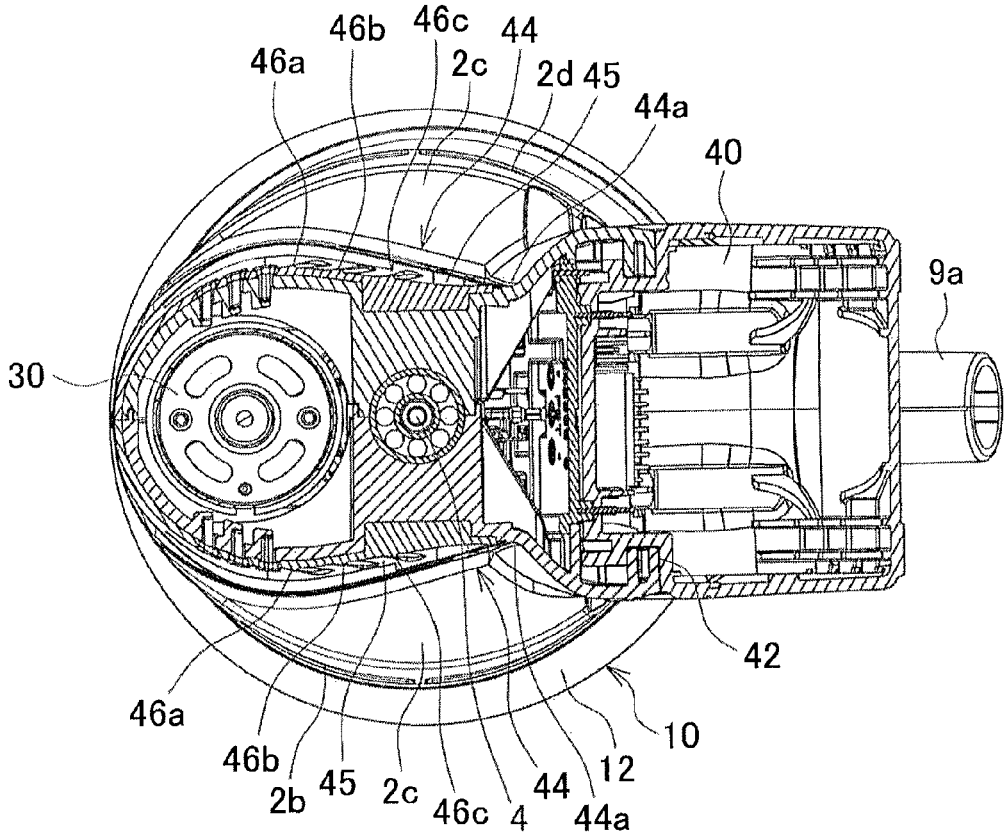
FIG. 5 is a sectional view taken along the line A-A of FIG. 4.
Figure 6:
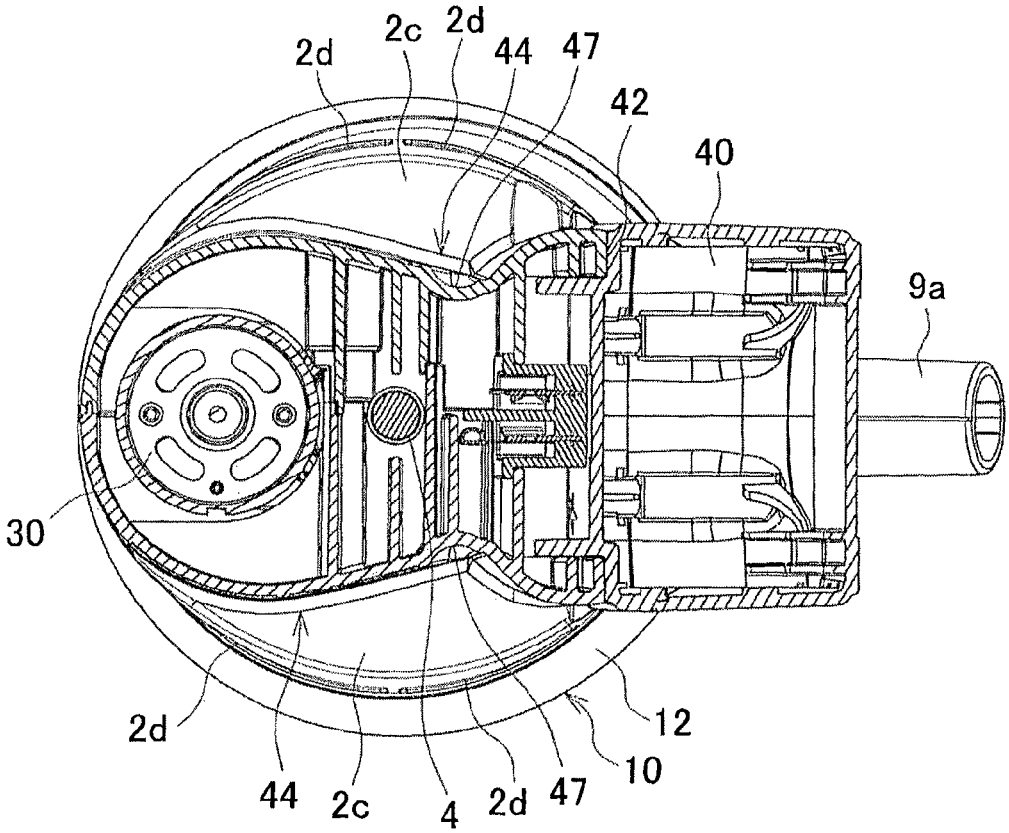
FIG. 6 is a sectional view taken along the line B-B of FIG. 4.

Further, as seen in FIGS. 5 and 6, the sander 1 includes an output shaft 4 at a center portion within the housing 2. The output shaft 4 extends in the vertical direction and is rotatable around its axis.

Figure 1:
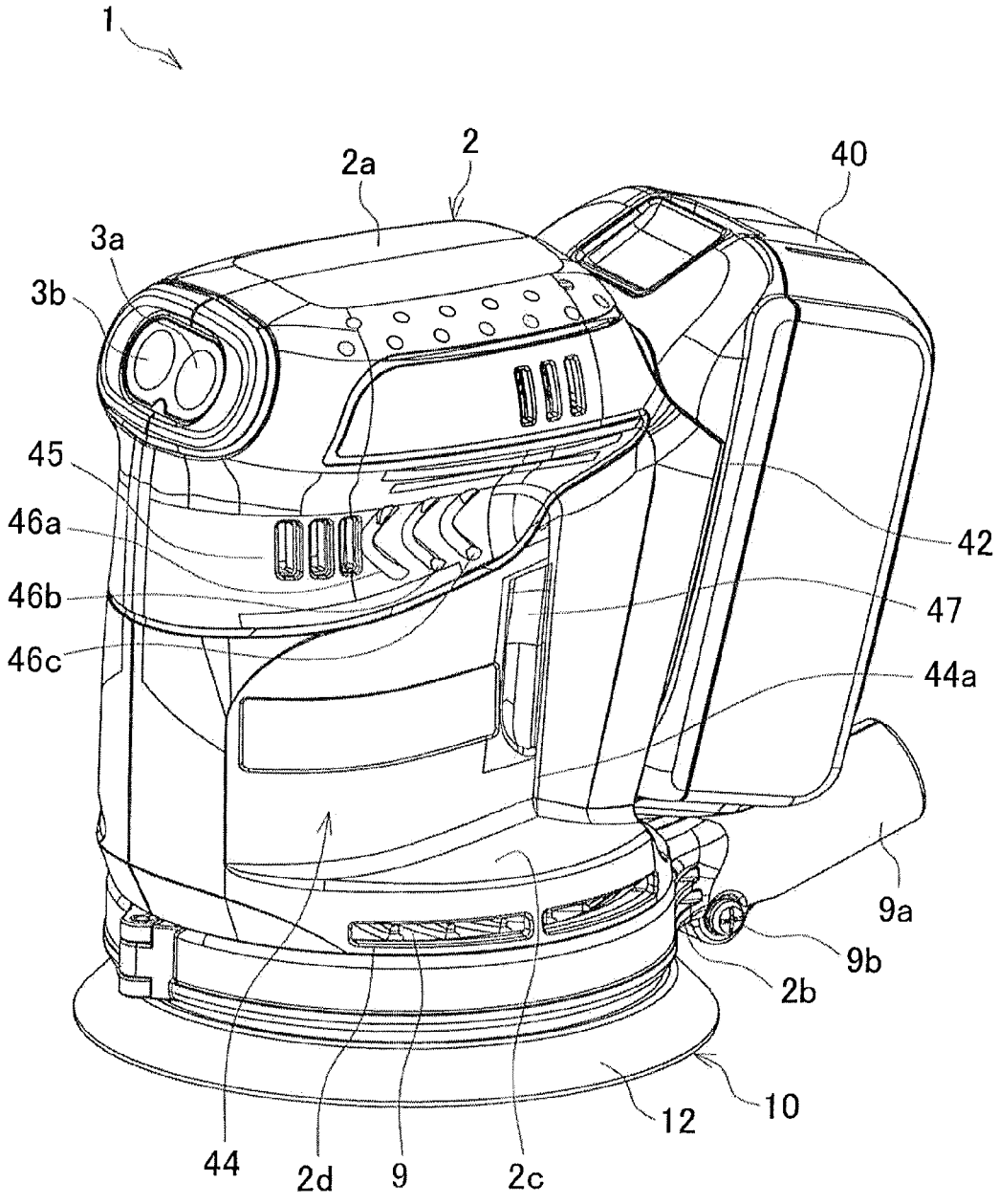
FIG. 1 is a perspective view of a sander according to the present invention.
Figure 2:
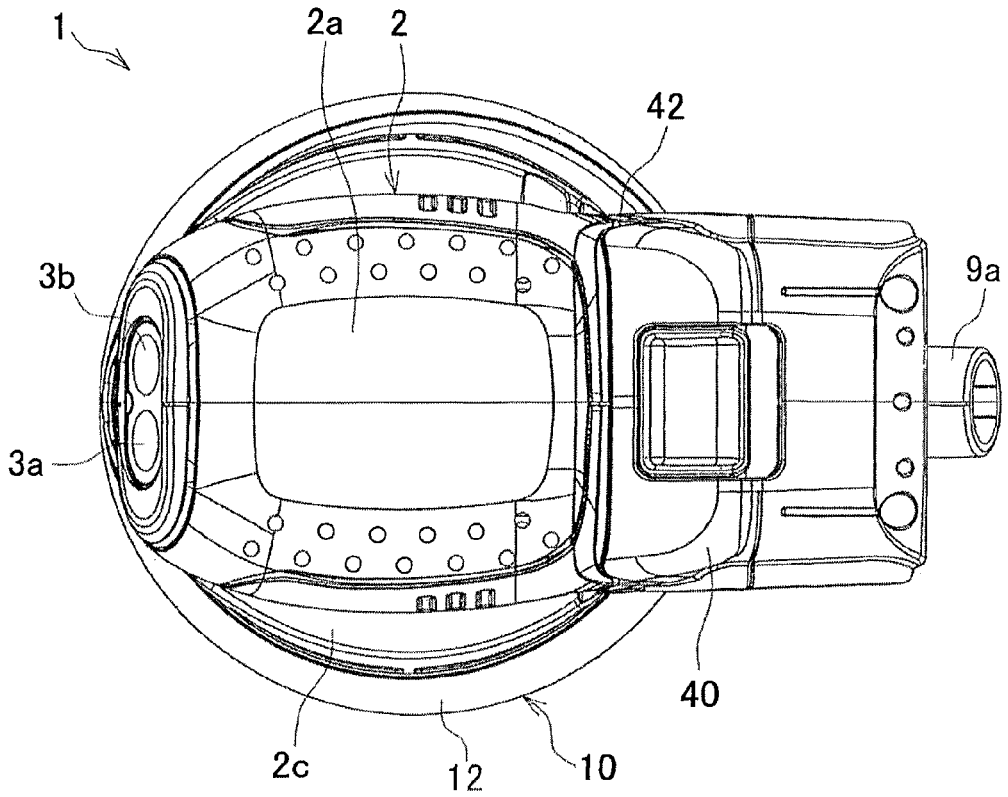
FIG. 2 is a top view of the sander shown in FIG. 1.
Figure 3:
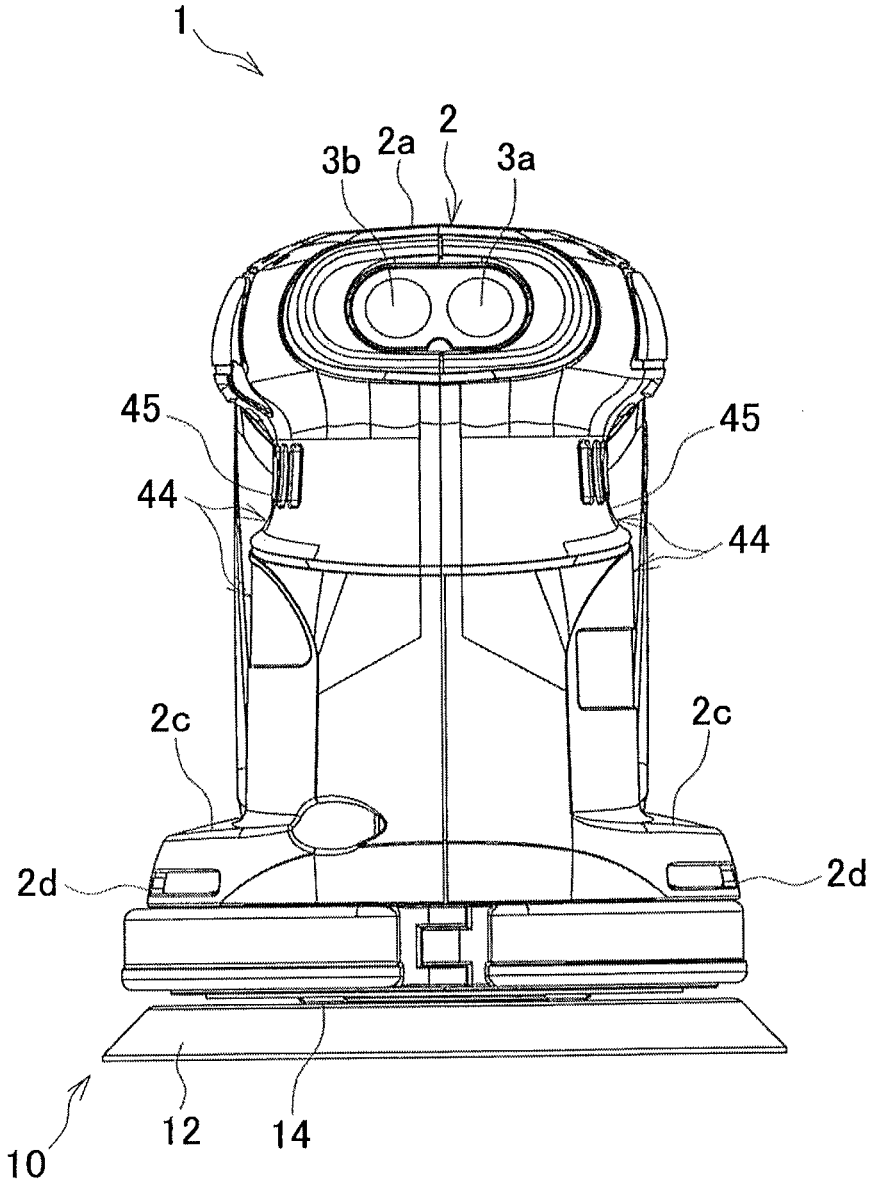
FIG. 3 is a front view of the sander shown in FIG. 1.
Figure 4:
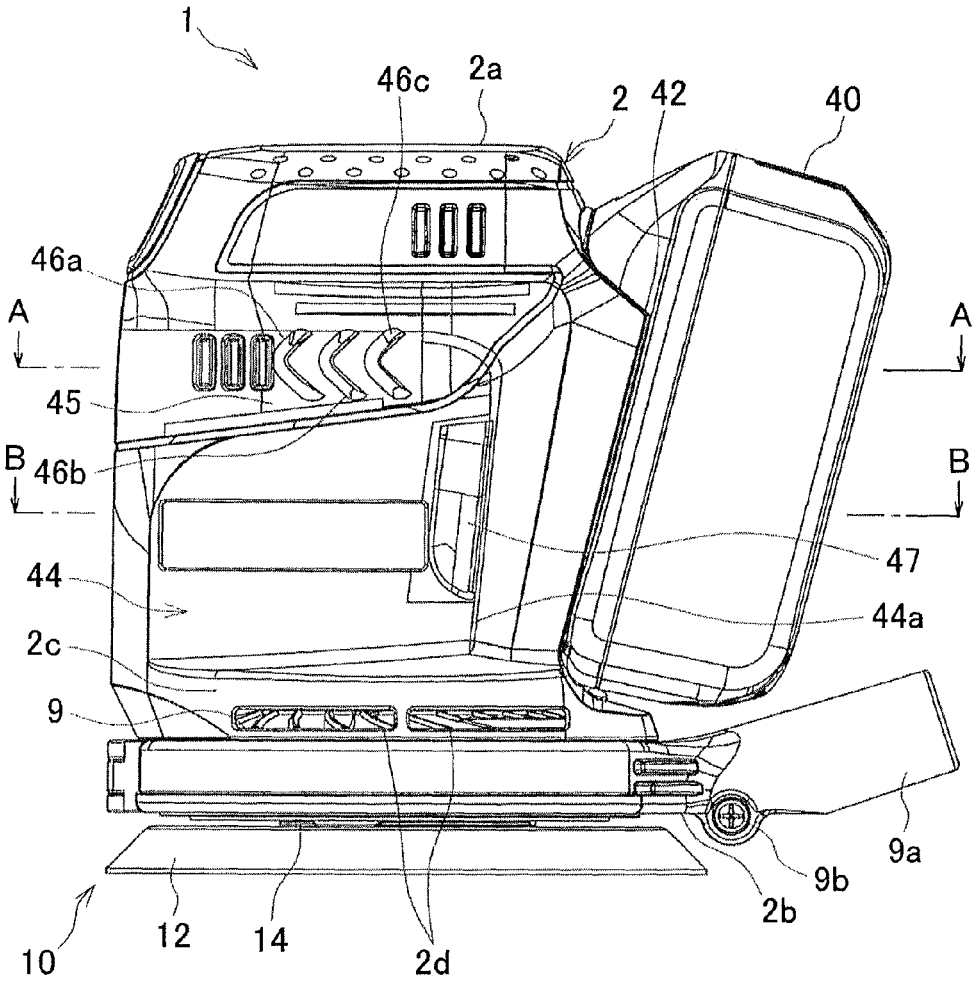
FIG. 4 is a side view of the sander shown in FIG. 1.

As best seen in FIGS. 1 and 4, a fan 9 is fixed to the output shaft 4 at around a lower mid portion of the output shaft 4. A fan-storage portion disposed in a lower portion of the housing 2 is formed and defined by a pair of extension portions 2*c* which extend outward beyond the outer peripheral walls of the housing 2. Discharge windows 2*d* configured to discharge air from the fan 9 are formed in a side surface of each extension portion 2*c*.

In addition, a connection portion 2*b* which is to be connected with a dust collection tube 9*a* for discharging dust-containing air is provided at a lower side of the housing 2 and at a side of the fan 9 (at a lower side of a battery attachment portion 42 to be described later). The dust collection tube 9*a* is fixed to the connection portion 2*b* by a connecting screw 9*b*.

A pad 10 is attached to a distal end of the output shaft 4, and an abrasive sanding paper (not shown) as an example of a tool is attached to a bottom surface of the pad 10, for example, through hook-and-loop fasteners.

The pad 10 includes a pad body 12 and a pad bearing device 14 disposed above the pad body 12. The pad bearing device 14 is fixed relative to the output shaft 4. A bearing (not shown) of the pad bearing device 14 is eccentrically arranged with respect to the center axis of the output shaft 4, so that when the output shaft 4 rotates, the pad 10 is driven to rotate (i.e., spins) around the center of the pad body 12 while the center of the pad body 12 makes an eccentric rotation (i.e., revolves) by the pad bearing device 14. In other words, the pad 10 creates an orbital rotation.

As seen in FIGS. 5 and 6, a motor 30 is provided within the housing 2 beside the output shaft 4.

A pulley (not shown) is fixed to a rotation shaft (not shown) disposed below the motor 30. At a position adjacent to the pulley, a pulley (not shown) is provided on the output shaft 4. A belt (timing belt, not shown) is looped around these pulleys. The pulley of the motor 30 is smaller in diameter than the pulley of the output shaft 4, so that the rotation of the rotation shaft 32 is reduced at the output shaft 4.

Further, a battery 40 is attached outside the housing 2 and at the opposite side of the motor 30 with respect to the upper portion 2*a* or the output shaft 4. Namely, the motor 30 is disposed at the opposite side of the battery 40 with respect to the holding portion or the output shaft 4.

The battery 40 is in the shape of a chamfered rectangular box, and one of its surfaces has one or plurality of terminals (not shown).

The battery 40 is a rechargeable battery configured to be rechargeable by a battery charger. Accordingly, the sander 1 is configured as a rechargeable type sander. In order to function as a switch for the motor 30 and the battery 40, the buttons 3*a*, 3*b* are electrically connected to the motor 30 and the battery 40.

The outer surface of the housing 2 (i.e., rear side of the sander 1) opposite from the motor 30 is formed as a battery attachment portion 42 having a shape corresponding to a terminal surface of the battery 40.

The battery attachment portion 42 is tilted inward as it goes downward, such that the battery 40 is guided in a tilted posture and positioned farther relative to the axis of the output shaft 4 (i.e., vertical direction of the sander 1) as it goes upward. In other words, the battery 40 is detachably attached to the battery attachment portion 42 by orienting the battery 40 at the inclination angle of the battery attachment portion 42 and sliding it into the battery attachment portion 42. The battery attachment portion 42 has a stopper portion (not shown) for engagement with the battery 40. The stopper portion is engaged with the battery 40 when the battery 40 is attached to the battery attachment portion 42, and disengaged when the battery 40 is removed from the battery attachment portion 42, so that the battery 40 is detachably received in the battery attachment portion 42. Further, the battery attachment portion 42 has one or plurality of terminals (not shown) at positions where they contact with the corresponding terminals of the battery 40 upon attachment of the battery 40. These terminals are electrically connected to the motor 30, so that the electric power of the attached battery 40 can be supplied to the motor 30.

The battery 40 is attached to the battery attachment portion 42 in a tilted posture such that the position of the battery 40 is disposed closer to the center portion of the sander 1 (the center portion of the housing 2) as it goes downward (i.e., the position of the battery is disposed inward as it goes downward). Further, the pad 10 (contacting portion of the pad 10), the battery 40 and the battery attachment portion 42 are formed such that the lower portion of the battery 40 as attached is positioned inward from the upper edge of the pad 10 (contacting portion of the pad 10).

As seen in FIG. 4, the battery 40 (the longitudinal center line of the battery 40) as attached to the battery attachment portion 42 is tilted at about 14 degrees from the vertical line.

Further, the battery 40 and the battery attachment portion 42 are formed such that the upper portion of the battery 40 becomes flush with an upper portion 2*a* of the housing 2 in a state in which the battery 40 is attached to the battery attachment portion 42.

The upper portion 2*a* of the housing 2 is formed to bulge outward on both sides of the outer peripheral walls (i.e., the pair of constrictions 44) of the housing 2. The buttons 3*a*, 3*b* are arranged at the front side of this bulged portion.

A pair of extension portions 2*c* as an example of an extension portion defined in the claims are provided at the lower side of the housing 2. The extension portions 2*c* extend outward on both sides of the housing 2. A pair of constrictions 44 as an example of at least one constriction defined in the claims are provided at both sides of the sander 1 in a position between the upper portion 2*a* and the extension portions 2*c*.

One of the pair of constrictions 44 will be mainly described in the following description because identical constrictions 44 are arranged symmetrically in the right and left sides of the sander 1.

The constriction 44 is formed so as to be sunk more deeply into the housing 2 as it goes rearward. To be more specific, the constriction 44 is formed so as to be closer to a central plane, which is positioned in the center between the right and left sides of the sander 1 (housing 2) and extends in the front-and-rear direction, as it goes rearward. As a whole, the constriction 44 is formed by a smoothly curved surface. The rear side of the constriction 44 extends sideward to form the battery attachment portion 42.

Accordingly, as viewed in a horizontal cross-sectional plane, the pair of constrictions 44 of the housing 2 are shaped as a rice paddle (see FIGS. 5 and 6) with the sides thereof being dented more deeply as they go rearward. To be more specific, the width (i.e., distance in the right-and-left direction) of the pair of constrictions 44 increases from the front end toward the rear side and is the maximum at a position around the motor 30, and thereafter gradually decreases toward the rear side. The shape of these constrictions 44 causes the user to hold the sander 1 not only from above but also from front. The term "front" indicates any directions "outside" the side peripheral portions defined in the claims. The direction in which the user holds the sander 1 from front or "outside" the side peripheral portions can be selected from any directions toward the side peripheral portions (front, rear, right and left) of the sander 1, and the "horizontal direction" (parallel to the lower surface of the pad 10) is preferable. However, the battery attachment portion 42 and its neighboring portion in case where the battery attachment portion 42 is provided on a side peripheral portion cannot be held.

Further, the outer length of the constriction 44 from its rear end edge 44*a* to its front end corresponds to the hand size of an average user, namely, the length from the fingertip of the user's finger (in particular the middle finger tip and not the thumb tip) to the central palm of the user. Accordingly, the rear end edge 44*a* of the constriction 44 is arranged rearward beyond (i.e., arranged closer to the battery attachment portion 42 than) the center of gravity of the entire sander 1 with the battery 40 attached thereto. It is to be noted that the center of gravity of the entire sander 1 is located in the vicinity of the output shaft 4 because the motor 4 and the battery 40 which are relatively heavy in weight are arranged opposite from each other with respect to the output shaft 4.

The upper part of the constriction 44 is provided with a dent portion 45 which is sunk more deeply into the outer peripheral walls of the housing 2 than the constriction 44. The dent portion 45 extends in the front-and-rear direction (i.e., horizontal direction) and has a depth approximately corresponding to half the thickness of the user's finger (in particular index finger). The length of the dent portion 45 in the front-and-rear direction approximately corresponds to that of the user's finger (in particular index finger).

Further, a plurality of projections 46*a*, 46*b*, 46*c* are formed on the dent portion 45. Each of the projections 46*a*, 46*b*, 46*c* has an arrowhead shape (waveform) pointing in the forward direction and extending sideward from the dent portion 45. The projections 46*a*, 46*b*, 46*c* are equidistantly arranged in the front-and-rear direction to contact with the central area or the entire area of the user's finger (in particular index finger).

As seen in FIGS. 1 and 6, provided at the rear end edge 44*a* of the constriction 44 is a stepped portion 47 which is sunk more deeply into the outer peripheral walls. The stepped portion 47 extends in the upper-and-lower direction and is configured such that when the user puts his hand on the constrictions 44 from front, the fingertips of the user's middle finger and ring finger are placed on the stepped portion 47.

The sander 1 configured as described above is operated as follows.

While the sander 1 is not in operation, the battery 40 is attached to the battery attachment portion 42. When the user depresses the button 3*b*, power is supplied to the motor 30 from the battery 40 and the rotation shaft 32 starts to rotate at a predetermined speed. If the user depresses the button 3*a*, the power supply from the battery 40 is interrupted, so that the operation of the motor 30 is ceased. If the user depresses the button 3*a* several times while the sander 1 is in operation, the rotation speed of the rotation shaft 32 can be changed into several different speeds in accordance with the number of times the button 3*a* is depressed.

The rotation shaft of the motor 30 causes the output shaft 4 to rotate through the belt and the pulleys as described above. When the output shaft 4 rotates, the pad 10 makes an orbital rotation by means of the pad bearing device 14. The user operates the sander 1 by holding the upper portion 2*a* and the constrictions 44 of the housing 2 and moving the sander 1 relative to a workpiece while pressing the rotating pad 10 against the workpiece. Accordingly, the surface of the workpiece is finished, for example, by grinding with an abrasive paper.

The upper portion 2*a* of the housing 2 provides a sufficient space for the user because the battery 40 is attached in a tilted posture. Further, the tilted posture of the battery 40 makes it possible to position the center of gravity of the sander 1 closer to the center portion as compared with the configuration in which the battery 40 is attached to the sander 1 without being tilted. In order to ensure the holding portion and to arrange the center of gravity closer to the center portion of the sander 1, it is preferable that the battery 40 is attached to the sander 1 at angles greater than 0 degrees with respect to the vertical line. On the contrary, if the battery 40 is attached to the sander 1 with a large tilting angle, the size of the sander 1 will be disadvantageously large or less space will be available for the internal structure. For this reason, it is preferable that the battery 40 is attached to the sander 1 at angles equal to or smaller than 30 degrees. It is to be noted that even when the battery 40 is attached to the sander 1 at an angle of 0 degree with respect to the vertical line (the longitudinally extending direction of the battery 40 coincides with the vertical line), a holding portion is ensured and the center of gravity of the sander 1 is still arranged closer to the center portion of the sander 1. Therefore, the battery 40 may be attached to the sander 1 in the range of angles from 0 degrees to 30 degrees with respect to the vertical direction.

Rotation of the output shaft 4 causes the fan 9 to rotate, so that the dust-containing air around the fan 9 is discharged from the dust collection tube 9*a* via the connection portion 2*b*.

According to the sander 1 in this embodiment, a pair of constrictions 44 are formed on both sides of the sander 1 away from the battery attachment portion 42 such that each constriction 44 is formed in the outer peripheral walls (side peripheral portions) and sunk into the outer peripheral walls and that the upper portion 2*a* of the housing 2 is formed to bulge outward on both sides of the outer peripheral walls (i.e., beyond the pair of constrictions 44 located below the upper portion 2*a*). Therefore, the user can easily hold the sander 1 from the front side thereof (i.e., any sides except the side on which the battery attachment portion 42 is provided) without interruption with the battery 40. Further, even if the user's hand is likely to slip and to move upward, the bulged upper potion 2*a* prevents the hand from slipping in the upward direction, thereby ensuring a stable operation of the sander 1. Further, because the constriction 44 is formed so as to be sunk more deeply into the outer peripheral walls as it goes rearward (i.e., farther from the side where the user holds the sander 1, that is, from the front side of the sander 1), the sander 1 fits better into the shape of the user's palm and fingers so that the reliability and stability of the operation can be improved.

Because the constriction 44 has projections 46*a*-46*c* which extend outward, the user can catch the projections 46*a*-46*c* with his hand (fingers) while holding the sander 1 from side. This can prevent the slippage of hand, especially in the front-and-rear direction. The projections 46*a*-46*c* prevent the hand from coming off the sander 1 (the constrictions 44 of the sander 1), thereby ensuring a more stable operation of the sander 1.

Further, because the constriction 44 is provided with the dent portion 45 which extends in the front-and-rear direction, the user can enter his fingers into the dent portion 45 while holding the sander 1 from side. This can prevent the slippage of hand in the vertical direction. Providing the dent portions 45 can prevent the hand from slipping in the downward direction and contacting with the pad 10, thereby ensuring a more stable operation of the sander 1.

Further, a pair of extension portions 2*c* which extend sideward are provided in the lower portion of the housing 2. This can prevent the hand from slipping in the downward direction and contacting with the pad 10, thereby ensuring a more stable operation of the sander 1.

Further, in addition to the dent portions 45, the rear end edge 44*a* (i.e., end edge adjacent to the battery attachment portion 42) of each constriction 44 has the stepped portion 47 which is sunk more deeply into the outer peripheral walls (located deep into the sander 1). Therefore, when the average user holds the sander 1 from side, the fingertips of the user's middle finger and ring finger can be placed on the stepped portion 47. Accordingly, the user can enter his fingertips deeply into the stepped portions 47 while grasping the sander 1. With this configuration, the user can easily tighten his grip to more reliably prevent the slippage of hand, thereby ensuring a more stable operation of the sander 1.

Further, the rear end edge 44*a* of each constriction 44 is arranged rearward beyond the vertical line passing through the center of gravity of the sander 1 (i.e., arranged farther from the side where the user holds the sander 1). Therefore, when the user holds the sander 1 from side peripheral portions other than the side where the battery attachment portion 42 is provided, he can hold the sander 1 such that its center of gravity is in the portion held by the user. It is therefore possible to provide a sander 1 which ensures a stable operation.

Although the present invention has been described in detail with reference to the above exemplary embodiment, the present invention is not limited to the above specific embodiment and various changes and modifications may be made without departing from the scope of the appended claims.

For example, the housing may be narrow not only at both sides thereof but also at the front side to form constrictions. As an alternative, the housing may be narrow at the front side thereof only or at one of its both sides. The shape of the constrictions may vary such that the user can hold the constrictions from any directions toward the side peripheral portions of the sander except the direction toward the front side of the sander (and also except the direction toward the rear side where the battery attachment portion is disposed) and that the constrictions are configured to be sunk more deeply as they go farther toward the far side. The dent portion may be provided at the center portion or at the lower portion of each constriction, or the width of the dent portion in the vertical direction may correspond to a plurality of fingers of the user. The projections may be provided on the constriction except for the area on the dent portion. Alternatively, the projections may be arranged at the upper part of the constriction and/or at the lower part of the constriction, or one projection may be provided on one side instead of a plurality of projections. Shape of each projection may be a W-shaped wave form, or a rod-shaped projection may be employed. Various arrangements of a plurality of projections may also be employed. Alternatively, a part of the plurality of projections may have a different shape with respect to the remaining projections, or three or more projections may be provided while the distance between them is not constant (e.g., a part of the distances may be different from the remaining ones). The stepped portion may extend in the horizontal direction, or the length of the stepped portion may vary such that only one fingertip of the user is put in the stepped portion. Further, the stepped portion may be arranged on the upper part of the constriction (i.e., in the dent portion). The pair of constrictions, dent portions, projections, and/or stepped portions may vary such that the shapes thereof are different between the right side and the left side or that they are provided at one of the right and left sides.

Further, the structure for attaching the battery to the battery attachment portion may vary, instead of slidably guiding the battery into the battery attachment portion, the battery may be directly attached to the battery attachment portion by directly engaging with a stopper portion. The battery attachment portion may have a box-like battery storage portion with or without a lid. The stopper portion for the battery, the fan and/or the dust collection tube may be omitted, and the number of screws, buttons and/or windows may be increased or decreased. Furthermore, functions, arrangements, types of various parts may vary where necessary. For example, the fan may be replaced with another type with consideration of not only a ventilating function but the weight. The buttons may be used for selecting various modes as well as for switching on and off the sander. Further, the buttons may be replaced with a lever switch, the belt and the pulleys may be replaced with gears, screws may be replaced with pins, and/or the battery to be attached to the sander may be a rechargeable battery or a single-use battery. The present invention is not limited to an orbital sander, in which the pad makes an orbital rotation, and may be applicable to other types of sander.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A sander comprising:

an upper portion configured as a holding portion;

side peripheral portions; and a constriction formed in the side peripheral portions and continuously sunk into the side peripheral portions, the constriction including a first constriction that extends in a horizontal direction and a second constriction that extends in a vertical direction, wherein the constriction is configured to be dent with respect to the holding portion.

2. The sander according to claim 1, wherein the constriction has projections.

3. The sander according to claim 1, wherein the constriction is provided with a dent portion which extends in a horizontal direction and is sunk more deeply into the side peripheral portions than the constriction.

4. The sander according to claim 1, wherein an extension portion configured to extend outward from the constriction is disposed at a lower side of the constriction.

5. The sander according to claim 1, wherein an end edge of the constriction has a stepped portion which is sunk more deeply into the side peripheral portions than the constriction.

6. The sander according to claim 1, further comprising a battery attachment portion, to which is attached a battery for supplying power to a motor to drive a pad, wherein an end edge of the constriction which is located close to the battery attachment portion is arranged closer to the battery attachment portion than the center of gravity of the entire sander.

7. The sander according to claim 1, further comprising an output shaft driven by a motor, and a pad attached to the output shaft, wherein when the output shaft rotates, the pad is driven to rotate around its center while the center of the pad makes an eccentric rotation.

8. The sander according to claim 1, further comprising a battery attachment portion, to which is attached a battery for supplying power to a motor to drive a pad, wherein the battery is attached to the battery attachment portion in a tilted posture such that the position of the battery is disposed closer to a center of the sander in the horizontal direction as it goes downward.

9. The sander according to claim 1, further comprising a battery attachment portion, to which is attached a battery for supplying power to a motor to drive a pad, wherein an upper portion of the battery is located at the same height with an upper portion of a housing of the sander in a state in which the battery is attached to the battery attachment portion.

10. The sander according to claim 1, wherein the constriction is configured to be sunk deeply into the side peripheral portions as it goes farther from a side where a user holds the sander.

11. A portable handheld sander comprising:

a top surface configured with a top holding surface;

a bottom surface oriented opposite to the top surface;

a front surface oriented between the top and bottom surfaces and configured with a front holding surface;

a rear surface oriented between the top and bottom surfaces and opposite to the front surface; and left and right side surfaces connecting the top surface with the bottom surface and the front surface with the rear surface, wherein the left and right side surfaces are constricted inward so as to form a concave surface continuously, each of the constricted side surfaces including a first constriction that extends in a horizontal direction and a second constriction that extends in a vertical direction.

* * * * *